US007021711B1

(12) United States Patent
Hoffman et al.

(10) Patent No.: US 7,021,711 B1
(45) Date of Patent: Apr. 4, 2006

(54) ROCKING-RECLINING SEATING UNIT WITH MOTION LOCK

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 10/982,108

(22) Filed: Nov. 4, 2004

(51) Int. Cl.
*A47C 3/03* (2006.01)

(52) U.S. Cl. ..... 297/270.1; 297/270.2; 297/270.3; 297/DIG. 7

(58) Field of Classification Search ..... 297/270.1, 297/270.2, 270.3, DIG. 7
See application file for complete search history.

(56) References Cited

U.S. PATENT DOCUMENTS 3,279,847 A * 10/1966 Re ..... 297/89
4,519,647 A * 5/1985 Rogers, Jr. ..... 297/85
4,707,025 A * 11/1987 Rogers, Jr. ..... 297/259.2
5,564,781 A * 10/1996 Pine ..... 297/267.1
5,876,094 A * 3/1999 Hoffman ..... 297/259.2
5,954,392 A * 9/1999 Liss et al. ..... 297/85
6,000,754 A * 12/1999 Lawson ..... 297/259.2
6,135,559 A * 10/2000 Kowalski ..... 297/354.12
6,231,120 B1 * 5/2001 Wiecek ..... 297/84
6,634,706 B1 * 10/2003 May ..... 297/85
6,733,071 B1 * 5/2004 Guillot et al. ..... 297/85
6,945,599 B1 * 9/2005 May ..... 297/270.1

* cited by examiner

*Primary Examiner*—Peter M. Cuomo
*Assistant Examiner*—Erika Garrett
(74) *Attorney, Agent, or Firm*—Myers Bigel Sibley & Sajovec

(57) ABSTRACT

A locking mechanism configured to prevent rocking motion of a seat of a rocking and reclining chair relative to a base of the chair when the chair is in a reclined position, the locking mechanism being interconnected with the base and with a reclining mechanism of the chair, includes: a drive link adapted to be pivotally interconnected with the reclining mechanism; a control link adapted to be pivotally interconnected with the base and having a slot; and a bracing link pivotally interconnected with the drive link and slidably and pivotally interconnected with the control link via a pin inserted into the control link slot, the bracing link including a wheel at an engagement end thereof. The locking mechanism is configured to be movable between a retracted position, in which the engagement end of the bracing link does not engage the base to prevent rocking motion of the chair, and an extended position, in which the engagement end of the bracing link engages a bearing surface of the base to prevent rocking movement of the chair.

25 Claims, 4 Drawing Sheets

ROCKING-RECLINING SEATING UNIT WITH MOTION LOCK

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "rocker-recliner," which can, when in the upright position, rock with a forward and rearward motion similar to that of a traditional rocking chair. A typical rocker recliner, one of which is illustrated in U.S. Pat. No. 4,519,647 to Rogers, includes an arcuate rocker cam that is attached with the lower portion of each mechanism, with the lower convex surface of the rocker cam contacting a level bearing surface of the base. Also, a spring assembly is mounted to the base of the chair and to each rocker cam. Each spring assembly includes two quite stiff, vertically-oriented helical springs attached to mounting brackets that are in turn fixed to the base and to the rocker cam. When the chair is in its upright position and is unoccupied, the seat, backrest and reclining mechanisms reside above the base, the rocker springs are deflected only along their longitudinal axes, and the rocker cams rest on a level portion of the base. When an occupant sits on the chair and applies a forwardly- or rearwardly-directed force to the seat or backrest, the seat and backrest move relative to the base. The path of movement is defined by the convex shape of the rocker cams as they rock on the level bearing surface of the base, with the result that the seat and backrest simulate the rocking motion of a rocking chair. During the rocking movement, the rocker springs deflect such that their top portions bend away from their longitudinal axes as the chair rocks forward and back. The deflection in the springs urges the springs (and, in turn, the seat and backrest) to return to their original positions as the chair returns to and through the upright position. In this manner, the chair is capable of providing a controlled rocking motion when in the upright position.

Many, if not all, chairs of this design include some type of safety feature, such as an extendable foot, that prevents rocking when the chair is in a reclined position. For example, U.S. Pat. No. 6,000,754 to Lawson discloses a rocker lock that is pivotally interconnected with the rear portion of the reclining mechanism and with the base of the chair. More specifically, the rocker lock includes three separate pivotally interconnected links mounted to the base and to the reclining mechanism. A bracket is mounted to and extends above the base. A slotted link is pivotally and slidably attached to the bracket via a pin on the bracket. A support link, to which a roller is attached, is pivotally interconnected with the forward end of the slotted link and with the reclining mechanism. A control link is pivotally interconnected with the support link and to the reclining mechanism. In the upright position, as the chair rocks, the slotted link moves forwardly and rearwardly relative to the mounting bracket, as the pin on the mounting bracket is free to slide within the slot of the slotted link as it moves. As the chair moves to an intermediate reclined position (often termed the "TV position"), movement of the reclining mechanism causes the control link to drive the roller on the support link downwardly into contact with a plate attached to the base. The slotted link is forced rearwardly so that the pin of the mounting bracket is lodged against the front edge of the slot. This placement of the wheel and the pin in the slot prevents the chair from rocking. This locking mechanism can have some shortcomings. Because the slotted link slides on the pin of the mounting bracket during the rocking motion, in some instances the occupant of the chair can rock forward sufficiently that the rear end of the slot strikes the pin, thereby giving a jolt to the occupant. Also, because of the configuration of the locking mechanism, if the occupant is rocking forward when releasing the chair to a reclined position, in some instances the chair can "catch" and impede reclining movement. As such, it may be desirable to provide additional configurations for motion locking mechanisms that can remove cost and/or labor from the manufacturing process and that can improve performance.

SUMMARY OF THE INVENTION

The present invention is directed to aspects of a motion locking mechanism for a rocker-recliner seating units that may reduce cost and/or simplify assembly while still providing adequate performance. As a first aspect, embodiments of the present invention are directed to a rocking and reclining seating unit that includes: a base having first and second generally horizontal bearing surfaces; a generally horizontally-disposed seat positioned above the base; a generally upright backrest positioned above the base and substantially rearward of the seat; a reclining mechanism attached to the seat and the backrest for moving said seat and backrest between upright and reclined positions relative to the base, the reclining mechanism comprising a plurality of pivotally interconnected links; a rocker cam attached with the reclining mechanism, the rocker cam including an arcuate lower contact surface positioned to contact the first bearing surface, the lower contact surface being configured for rolling contact with the first bearing surface such that the seat has a rocking motion relative to the base; a rocker spring assembly that includes a resilient member that biases the seat against rocking motion relative to the base, the rocker spring assembly being attached with a respective reclining assembly and with the base; and a locking mechanism configured to prevent rocking motion of the seat relative to the base when the chair is in a reclined position, the locking mechanism being interconnected with the base and with the reclining mechanism. The locking mechanism includes: a drive link pivotally interconnected with the reclining mechanism; a control link pivotally interconnected with the base, the control link including a slot; and a bracing link pivotally and slidably interconnected with the control link via a pin mounted to the bracing link and inserted into the control link slot. The bracing link is further pivotally interconnected with the drive link and has an engagement end. The locking mechanism is movable between a retracted position, in which the engagement end of the bracing link does not engage the base to prevent rocking motion of the seating unit, and an extended position, in which the engagement end of the bracing link engages the second bearing surface of the base to prevent rocking movement of the seating unit. The locking unit is coupled with the reclining mechanism such that, when the seating unit is in the upright position, the locking mechanism is in the retracted position, and when the seating unit is in one of the reclined positions, the locking mechanism is in the extended position. This configuration can employ fewer parts and improve operation of the locking mechanism, particularly when the lock is in the open position.

In some embodiments, when the seating unit is in the upright position and follows the rocking motion, the bracing link pin reciprocates within the control link slot. When the seating unit is in a reclined position, the bracing link pin engages an upper end of the control link slot.

As an additional aspect, embodiments of the present invention are directed to a locking mechanism for a rocking and reclining seating unit. More specifically, the locking mechanism is configured to prevent rocking motion of a seat of a rocking and reclining chair relative to a base of the chair when the chair is in a reclined position, the locking mechanism being interconnected with the base and with a reclining mechanism of the chair. The locking mechanism includes: a drive link adapted to be pivotally interconnected with the reclining mechanism; a control link adapted to be pivotally interconnected with the base and having a slot; and a bracing link pivotally interconnected with the drive link and slidably and pivotally interconnected with the control link via a pin inserted into the control link slot, the bracing link including a wheel at an engagement end thereof. The locking mechanism is configured to be movable between a retracted position, in which the engagement end of the bracing link does not engage the base to prevent rocking motion of the chair, and an extended position, in which the engagement end of the bracing link engages a bearing surface of the base to prevent rocking movement of the chair.

As a third aspect, embodiments of the present invention are directed to a reclining seating unit for a rocking and reclining unit having: a base having first and second generally horizontal bearing surfaces; a generally horizontally-disposed seat positioned above the base; a generally upright backrest positioned above the base substantially rearward of the seat; a reclining mechanism for moving the seat and backrest between upright and reclined positions relative to the base, the reclining mechanism comprising a plurality of pivotally interconnected links and including a backpost fixed to the backrest and a transition plate pivotally interconnected to the backpost; a rocker cam attached with the reclining mechanism, the rocker cam including an arcuate lower contact surface positioned to contact the first bearing surface, the lower contact surface being configured for rolling contact with the first bearing surface such that the seat has a rocking motion relative to the base; a rocker spring assembly that includes a resilient member that biases said seat against rocking motion relative to said base, the rocker spring assembly being attached with a respective reclining mechanism and to the base; and a locking mechanism configured to prevent rocking motion of the seat relative to the base when the chair is in a reclined position, the locking unit being coupled with the reclining mechanism such that, when the seating unit is in the upright position, the locking mechanism is in the retracted position, and when the seating unit is in one of the reclined positions, the locking mechanism is in the extended position. The transition plate of the reclining mechanism includes a slot, and the backpost of the reclining mechanism includes a pin that extends into the transition plate slot. This configuration can improve movement of the seating unit from a fully reclined position to the upright position by controlling the sequence in which the links pivot as the ottoman returns from its extended position.

DETAILED DESCRIPTION OF EMBODIMENTS OF THE INVENTION

Figure 1:
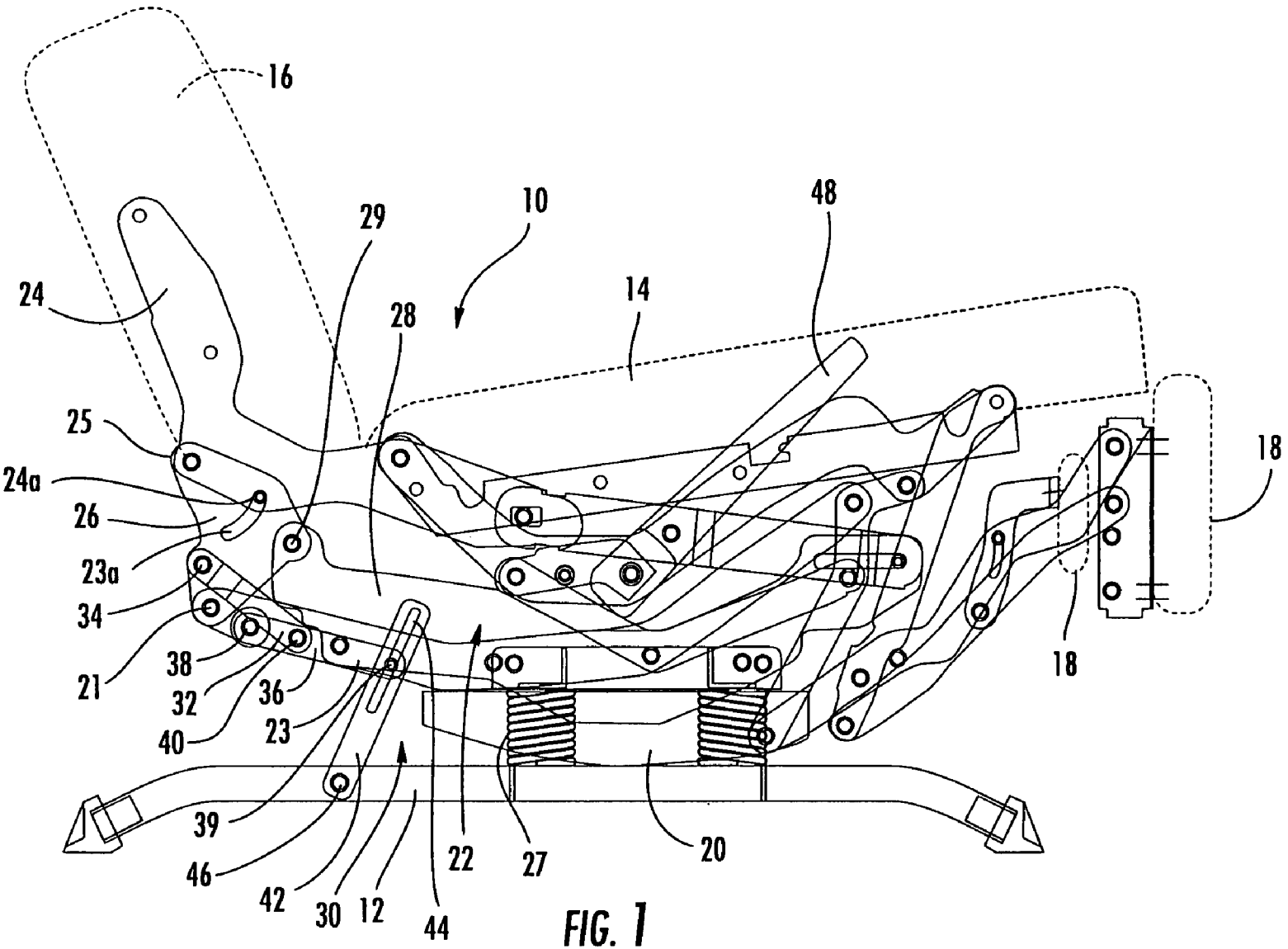
FIG. 1 is a side view of a seating unit according to embodiments of the present inventions, wherein the seating unit is in its upright position and is free to rock.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4–21 (1979).

Referring now to the figures, a rocker-recliner chair, designated broadly at 10, is illustrated in FIGS. 1–4. The chair 10 includes a base 12, a seat 14 that is generally horizontally disposed above the base 12, a backrest 16 that is generally vertically disposed substantially above a rear portion of the seat 12, and two ottomans 18, which, in the upright position of FIG. 1, are generally vertically disposed below a front portion of the seat 16.

A pair of mirror image reclining mechanisms 22 (only one of which is shown herein) are attached to the backrest 16, the seat 14, and the ottomans 18. The reclining mechanisms 22, which comprise a plurality of interconnected links, move the chair 10 between (a) an upright position (FIGS. 1 and 2), in which the seat 14 is generally horizontally disposed, the backrest 16 is generally vertically disposed, and the ottomans are generally vertically disposed and positioned below the seat 14, (b) an intermediate TV position (FIG. 3), in which the ottomans 18 are generally horizontally disposed in front of the seat 14 (not shown in FIG. 3) and the backrest 16 and the seat 14 substantially maintain the same relationship as they have in the upright position, and (c) a fully reclined position (FIG. 4), in which the angle between the backrest 16 and the seat 14 increases.

The reclining mechanisms 22 are attached to the base 12 via rocker cams 20, which rest on the upper bearing surfaces of the legs of the base 12. The arcuate lower surfaces of the cams 20 are configured for rolling contact with the bearing surfaces and enable the chair 10 to have a fore-to-aft rocking motion. This motion is controlled by rocker spring assemblies 27 that are attached with the base 12 and with the reclining mechanisms 22. In the illustrated embodiment, the rocker spring assemblies 27, which have resilient members that bias the seat 14 against rocking motion, are attached directly to the base 12 and to a chassis assembly that is sandwiched between the rocker cams 20 and the reclining mechanism 22, but it is to be understood that the rocker spring assemblies 27 may also be attached directly to the reclining mechanism 22 in other embodiments, such as in the manner illustrated in U.S. Pat. No. 5,876,094 to Hoffman, and that the reclining mechanism can be mounted directly onto the rocker cams 20 as illustrated in the U.S. Pat. No. 6,000,754 to Lawson.

It is desirable that the chair 10 not be able to rock when it is in either of the TV or fully reclined positions, as such motion can create an unwelcome feel of instability to an occupant of the chair 10. To prevent rocking in the TV and fully reclined positions, the chair 10 includes two mirror image locking mechanisms 30, only one of which is shown herein. The structure and operation of one of the locking mechanisms 30 are discussed below. More specifically, the structure of the locking mechanism 30 will be described with the chair 10 in the upright position; changes in the relative positions of the components of the locking mechanism 30 as they move to the TV and fully reclined positions will be described subsequently.

Figure 2:
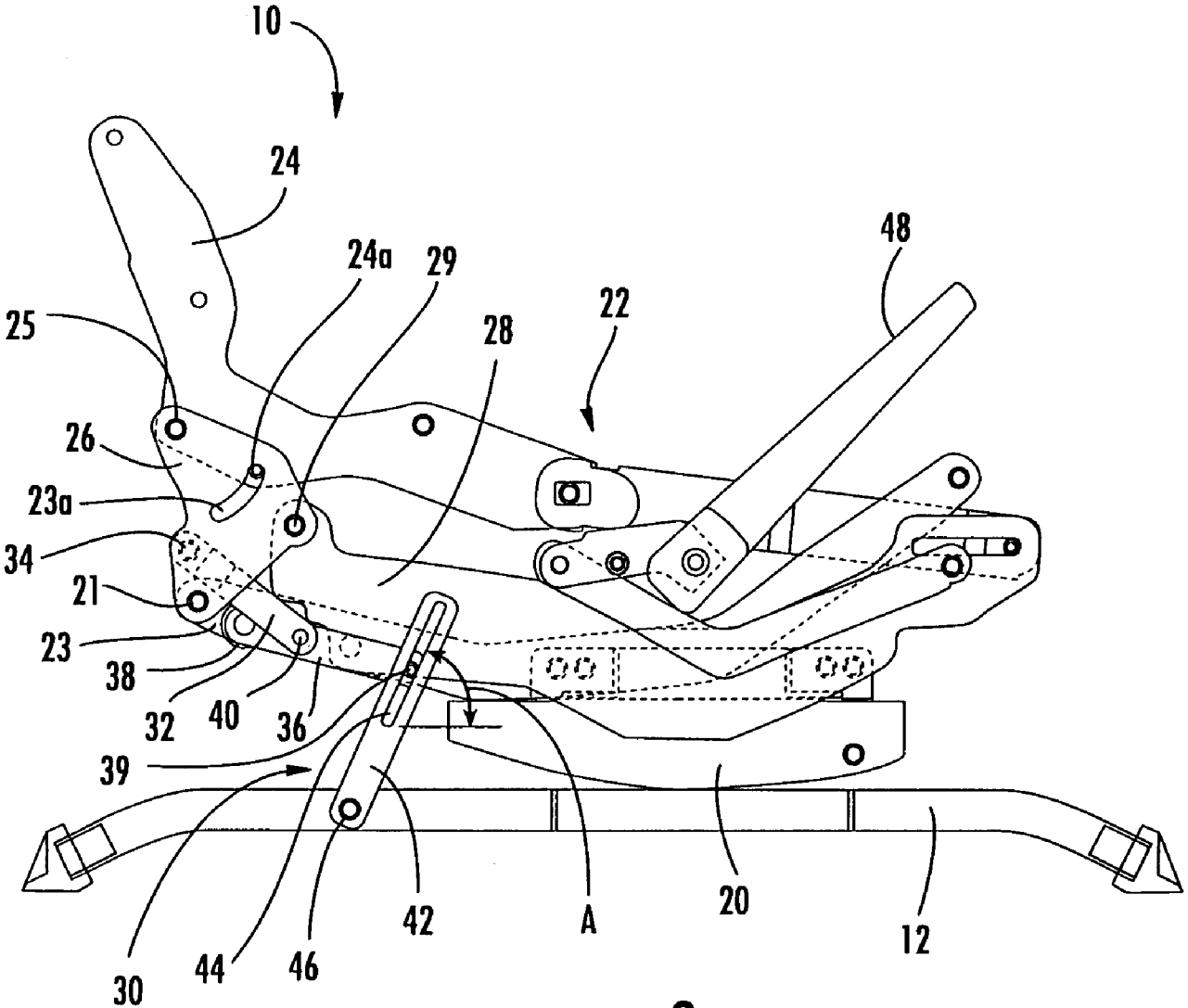
FIG. 2 is a partial side view of the locking mechanism of the seating unit of FIG. 1, with portions of the reclining mechanism removed for clarity, wherein the seating unit is in its upright position and is free to rock.
Figure 3:
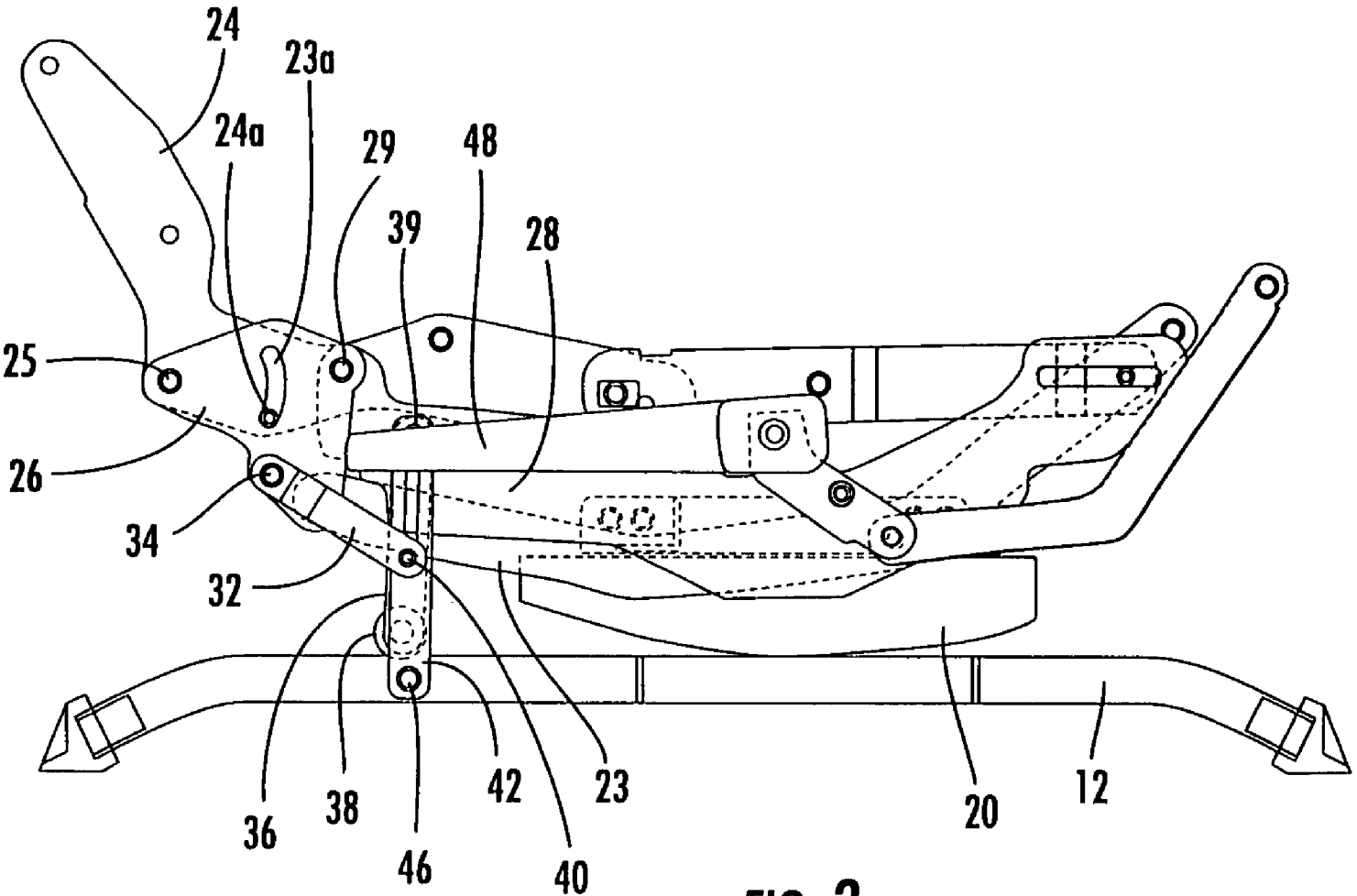
FIG. 3 is a partial side view of the locking mechanism of the seating unit of FIG. 1, with portions of the reclining mechanism removed for clarity, wherein the seating unit is in its intermediate TV position and is prevented from rocking by the locking mechanism.

Referring first to FIGS. 1 and 2, the locking mechanism 30 includes a drive link 32 that is pivotally interconnected at one end to a trapezoidal transition plate 26 of the reclining mechanism at a pivot 34. The drive link 32 is a straight link that slopes downwardly and forwardly from the pivot 34. The opposite end of the drive link 32 is pivotally interconnected with the intermediate portion of a straight bracing link 36 at a pivot 40. When the chair 10 is in the upright position of FIGS. 1 and 2, the bracing link 36 is generally horizontally disposed. The bracing link 36 includes a wheel 38 or other engagement structure at its rearward (or engagement) end, and further includes a pin 39 at its forward end. A straight control link 42 is pivotally interconnected with the base 12 at a pivot 46; the control link 42 extends upwardly and slightly forwardly therefrom. The control link 42 includes in its upper half a slot 44 within which the pin 39 of the bracing link 36 resides. The slot 44 of the control link 42 is disposed at an angle A to the underlying surface. The angle A is typically between about 60 and 75 degrees.

As can be seen from FIGS. 1 and 2, when the chair 10 is in its upright position, the locking mechanism 30 is in a retracted position that allows the chair 10 to rock. During the rocking motion, the majority of the locking mechanism 30 is stationary relative to the reclining mechanisms 22. Because the bracing link 36 does not move relative to the reclining mechanism 22 as the chair 10 rocks, similarly the pin 39 that resides in the slot 44 in the control link 42 does not move relative to the reclining mechanism 22 as the chair 10 rocks. However, the presence of the slot 44 permits the pin 39 to slide and/or reciprocate therein when the chair 10 is rocking. In the illustrated embodiment, the control link 42 moves very little during the rocking motion; however, in other embodiments, the control link 42 may pivot about the pivot 46 during rocking.

To move the chair 10 from the upright position (FIGS. 1 and 2) to the TV position (FIG. 3), the occupant of the chair 10 pulls rearwardly on a handle 48 that is mounted in an arm of the chair 10. The reclining motion of the links comprising the reclining mechanism 22 will be understood by those skilled in this art and need not be described in detail herein. However, during the movement from the upright position to the TV position, the transition plate 26, which is pivotally interconnected with a backpost 24, a transition link 23, and a mounting plate 28 of the reclining mechanisms 22 at, respectively, pivots 25 and 29, rotates approximately forty-five degrees relative to the base 12 until the lower end of a slot 23*a* reaches a pin 24*a* on the backpost 24. This rotation, which is largely about the pivots 21 and 29, drives the pivot 34 between the transition plate 26 and the drive link 32 downwardly and forwardly (the rotation of the transition plate 26 is counterclockwise from the vantage point of FIGS. 1–4). The movement of the transition plate 26 drives the drive link 32 downward and forward. The forward motion of the drive link 32 causes the bracing link 36 to rotate such that its forward end rises and moves rearwardly and such that its rearward end, on which the wheel 38 is mounted, descends and moves forwardly (this rotation is counterclockwise from the vantage point of FIGS. 1–4). Also, the elevation of the forward end of the bracing link 36 causes the pin 39 to rise to the top of the slot 44 of the control link 42. The control link 42 also rotates slightly about the pivot 46 to take a more vertical disposition. The movement of these links ceases when the wheel 38 engages a portion of the upper bearing surface of the base 12 rearward of the portion of the bearing surface beneath the rocker cams 20 (these portions may or may not be contiguous). In this position, the linkage between the bracing link 36, the drive link 32 and the transition plate 26 restrains the mounting plate 28, thereby preventing the reclining mechanisms 22, and in turn the chair 10, from rocking relative to the base 12.

Figure 4:
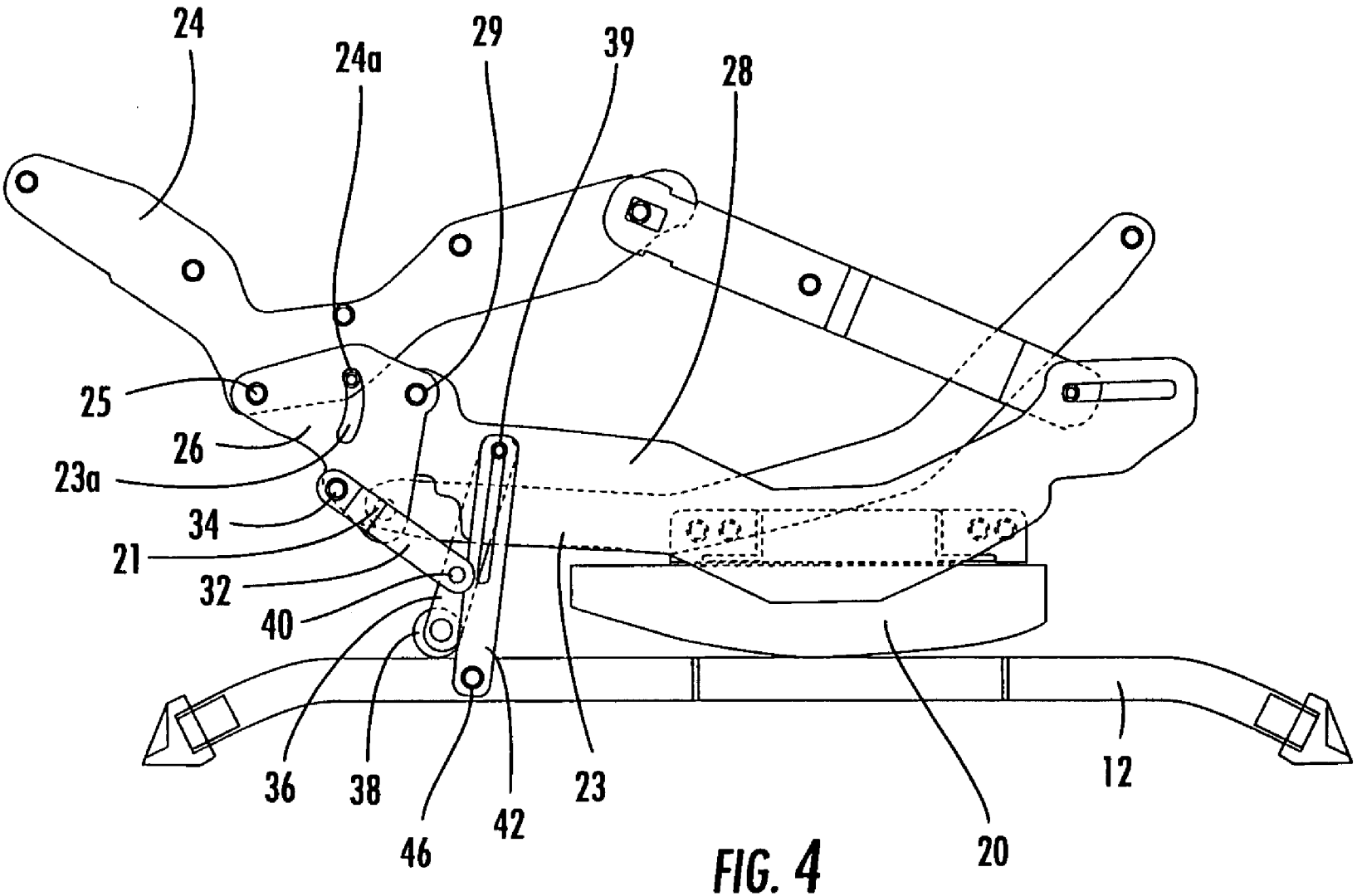
FIG. 4 is a partial side view of the locking mechanism of the seating unit of FIG. 1, with portions of the reclining mechanism removed for clarity, wherein the seating unit is in its fully reclined position and is prevented from rocking by the locking mechanism.

As can be seen in FIG. 4, the locking mechanism 30 continues to prevent the chair 10 from rocking as the chair 10 moves to the fully reclined position. To move the chair to the fully reclined position, the occupant applies a rearwardly directed force to the backrest 16 (typically by pressing forward on the arms of the chair 10, which in turn presses the occupant's back into the backrest 16). This force tilts the backpost 24 rearwardly, which draws the transition plate 26 and the drive link 32 slightly rearwardly until the pin 24*a* reaches the upper end of the slot 23*a*. Consequently, the bracing link 36 is drawn slightly rearwardly. However, the pin 39 on the bracing link 36 remains at the top of the slot 44 of the control link 42, with the result that the locking mechanism 30 constrains the reclining mechanism 22 and, in turn, the chair 10, from rocking relative to the base 12.

This configuration of the locking mechanism enables the chair 10 to have locking capability in the reclined positions with only three links beyond those employed in the reclining mechanism. As such, the locking mechanism 30 can be produced and assembled relatively inexpensively, particularly with reclining mechanisms that include a transition plate 26 or similar member that rotates forwardly relative to the backpost of the reclining mechanism in the TV position. In addition, the inclusion of the slotted control link 42 allows the chair 10 to rock freely without "bottoming out" in the forward position, as the slot 44 can be formed of sufficient length that the cam 20 can roll to its forward end without the pin 39 striking the upper end of the slot 44. In addition, the locking mechanism 30 can avoid any tendency to "catch" when the chair is moving to the TV position even if the chair 10 is rocked forward.

Those skilled in this art will appreciate that other types of seating units, including love seats, sofas, couches, and the like, may also be employed with the present invention. Also, although the chair illustrated herein is a "three-way" rocker-recliner, other reclining units, including "one-way" and "two-way" reclining units, may also employ and benefit from a locking mechanism of the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A rocking and reclining seating unit, comprising:

a base having first and second generally horizontal bearing surfaces;

a generally horizontally-disposed seat positioned above the base;

a generally upright backrest positioned above the base and substantially rearward of the seat;

a reclining mechanism attached to the seat and the backrest for moving said seat and backrest between upright and reclined positions relative to said base, the reclining mechanism comprising a plurality of pivotally interconnected links;

a rocker cam attached with the reclining mechanism, the rocker cam including an arcuate lower contact surface positioned to contact the first bearing surface, the lower contact surface being configured for rolling contact with the first bearing surface such that the seat has a rocking motion relative to the base;

a rocker spring assembly that includes a resilient member that biases the seat against rocking motion relative to the base, the rocker spring assembly being attached with a respective reclining assembly and with the base; and a locking mechanism configured to prevent rocking motion of the seat relative to the base when the chair is in a reclined position, the locking mechanism being interconnected with the base and with the reclining mechanism, the locking mechanism including:

a drive link pivotally interconnected with the reclining mechanism;

a control link pivotally interconnected with the base, the control link including a slot; and a bracing link pivotally and slidably interconnected with the control link via a pin mounted to the bracing link and inserted into the control link slot, the bracing link being further pivotally interconnected with the drive link, the bracing link having an engagement end:

the locking mechanism being movable between a retracted position, in which the engagement end of the bracing link does not engage the base to prevent rocking motion of the seating unit, and an extended position, in which the engagement end of the bracing link engages the second bearing surface of the base to prevent rocking movement of the seating unit; the locking unit being coupled with the reclining mechanism such that, when the seating unit is in the upright position, the locking mechanism is in the retracted position, and when the seating unit is in one of the reclined positions, the locking mechanism is in the extended position.

2. The seating unit defined in claim 1, wherein the bracing link includes a wheel at the engagement end that engages the second bearing surface of the base in the extended position.

3. The seating unit defined in claim 1, wherein, when the seating unit is in the upright position and follows the rocking motion, the bracing link pin is free to reciprocate within the control link slot.

4. The seating unit defined in claim 3, wherein the locking mechanism is configured such that, when the seating unit is in a reclined position, the bracing link pin engages an upper end of the control link slot.

5. The seating unit defined in claim 1, wherein the reclining mechanism is a three-way mechanism.

6. The seating unit defined in claim 5, wherein the locking mechanism is configured such that, when the seating unit is in the TV position, the engagement end of the bracing link is in a first position, and when the seating unit is in the fully reclined position, the engagement end of the bracing link is in a second position that is rearward of the first position.

7. The seating unit defined in claim 1, wherein the reclining mechanism has a backpost attached to the backrest and a transition link that includes a slot, and wherein the backpost includes a pin that extends into the transition link slot.

8. The seating unit defined in claim 1, wherein the first and second bearing surfaces are contiguous.

9. A rocking and reclining seating unit, comprising:

a base having first and second generally horizontal bearing surfaces;

a generally horizontally-disposed seat positioned above the base;

a generally upright backrest positioned above the base substantially rearward of the seat;

a reclining mechanism for moving the seat and backrest between upright and reclined positions relative to the base, the reclining mechanism comprising a plurality of pivotally interconnected links and including a backpost fixed to the backrest and a transition plate pivotally interconnected to the backpost;

a rocker cam attached with the reclining mechanism, the rocker cam including an arcuate lower contact surface positioned to contact the first bearing surface, the lower contact surface being configured for rolling contact with the first bearing surface such that the seat has a rocking motion relative to the base;

a rocker spring assembly that includes a resilient member that biases said seat against rocking motion relative to said base, the rocker spring assembly being attached with a respective reclining mechanism and to the base; and a locking mechanism configured to prevent rocking motion of the seat relative to the base when the chair is in a reclined position, the locking mechanism being interconnected with the base and with the reclining mechanism, the locking mechanism including:

a drive link pivotally interconnected with the transition plate of the reclining mechanism;

a control link pivotally interconnected with the base; and a bracing link pivotally interconnected with the control link and the drive link and having an engagement end;

the locking mechanism being movable between a retracted position, in which the engagement end of the bracing link does not engage the base to prevent rocking motion of the seating unit, and an extended position, in which the engagement end of the bracing link engages the second bearing surface of the base to prevent rocking movement of the seating unit;

the locking unit being coupled to with the reclining mechanism such that, when the seating unit is in the upright position, the locking mechanism is in the retracted position, and when the seating unit is in one of the reclined positions, the locking mechanism is in the extended position.

10. The seating unit defined in claim 9, wherein the bracing link includes a wheel at one end that engages the second bearing surface of the base in the extended position.

11. The seating unit defined in claim 9, wherein the bracing link is slidably and pivotally connected to the control link.

12. The seating unit defined in claim 11, wherein the control link includes a slot, and wherein the bracing link includes a pin that extends into the control link slot.

13. The seating unit defined in claim 12, wherein, when the seating unit is in the upright position and follows the rocking motion, the bracing link pin reciprocates within the control link slot.

14. The seating unit defined in claim 12, wherein the locking mechanism is configured such that, when the seating unit is in a reclined position, the bracing link pin engages an upper end of the control link slot.

15. The seating unit defined in claim 9, wherein the reclining mechanism is a three-way mechanism.

16. The seating unit defined in claim 15, wherein the locking mechanism is configured such that, when the seating unit is in the TV position, the engagement end of the bracing link is in a first position, and when the seating unit is in the fully reclined position, the engagement end of the bracing link is in a second position that is rearward of the first position.

17. The seating unit defined in claim 16, wherein the transition plate includes a slot, and wherein the backpost includes a pin that extends into the transition plate slot.

18. The seating unit defined in claim 17, wherein in the TV position, the backpost pin is in the bottom end of the transition plate slot, and in the fully reclined position, the backpost pin is in the top end of the transition plate slot.

19. The seating unit defined in claim 1, wherein the first and second bearing surfaces are contiguous.

20. A locking mechanism configured to prevent rocking motion of a seat of a rocking and reclining chair relative to a base of the chair when the chair is in a reclined position, the locking mechanism being interconnected with the base and with a reclining mechanism of the chair, the locking mechanism including:

a drive link adapted to be pivotally interconnected with the reclining mechanism;

a control link adapted to be pivotally interconnected with the base and having a slot; and a bracing link pivotally interconnected with the drive link and slidably and pivotally interconnected with the control link via a pin inserted into the control link slot, the bracing link including a wheel at an engagement end thereof;

the locking mechanism being configured to be movable between a retracted position, in which the engagement end of the bracing link does not engage the base to prevent rocking motion of the chair, and an extended position, in which the engagement end of the bracing link engages a bearing surface of the base to prevent rocking movement of the chair.

21. The locking mechanism defined in claim 20, wherein, when the seating unit is in the upright position and follows the rocking motion, the drive link pin reciprocates within the control link slot.

22. The locking mechanism defined in claim 20, wherein the locking mechanism is configured such that, when the seating unit is in a reclined position, the drive link pin engages an upper end of the control link slot.

23. A rocking and reclining seating unit, comprising:

a base having first and second generally horizontal bearing surfaces;

a generally horizontally-disposed seat positioned above the base;

a generally upright backrest positioned above the base substantially rearward of the seat;

a reclining mechanism for moving the seat and backrest between upright and reclined positions relative to the base, the reclining mechanism comprising a plurality of pivotally interconnected links and including a backpost fixed to the backrest and a transition plate pivotally interconnected to the backpost;

a rocker cam attached with the reclining mechanism, the rocker cam including an arcuate lower contact surface positioned to contact the first bearing surface, the lower contact surface being configured for rolling contact with the first bearing surface such that the seat has a rocking motion relative to the base;

a rocker spring assembly that includes a resilient member that biases said seat against rocking motion relative to said base, the rocker spring assembly being attached with a respective reclining mechanism and to the base; and a locking mechanism configured to prevent rocking motion of the seat relative to the base when the chair is in a reclined position, the locking unit being coupled with the reclining mechanism such that, when the seating unit is in the upright position, the locking mechanism is in the retracted position, and when the seating unit is in one of the reclined positions, the locking mechanism is in the extended position; the transition plate of the reclining mechanism including a slot, and the backpost of the reclining mechanism including a pin that extends into the transition plate slot.

24. The seating unit defined in claim 23, wherein the reclining mechanism is a three-way mechanism.

25. The seating unit defined in claim 24, wherein in the TV position, the backpost pin is in the bottom end of the transition plate slot, and in the fully reclined position, the backpost pin is in the top end of the transition plate slot.

* * * * *